US007762034B2

(12) United States Patent
Jankovec et al.

(10) Patent No.: US 7,762,034 B2
(45) Date of Patent: Jul. 27, 2010

(54) ROTARY STITCH FOR JOINING SHEET METAL STOCK

(75) Inventors: Scott G. Jankovec, Elmhurst, IL (US); Peter G. Jahn, Palos Park, IL (US); Loring M. Johnson, Tinley Park, IL (US); Matthew D. Jacobs, Chicago, IL (US)

(73) Assignee: Chicago Metallic Corporation, Chicago, IL (US)

( * ) Notice: Subject to any disclaimer, the term of this patent is extended or adjusted under 35 U.S.C. 154(b) by 0 days.

(21) Appl. No.: 12/566,175

(22) Filed: Sep. 24, 2009

(65) Prior Publication Data

US 2010/0077687 A1 Apr. 1, 2010

Related U.S. Application Data

(60) Provisional application No. 61/100,443, filed on Sep. 26, 2008.

(51) Int. Cl.
*E04B 5/00* (2006.01)
*E04B 2/00* (2006.01)

(52) U.S. Cl. ..... 52/506.07; 52/506.01; 52/506.06; 29/432.2

(58) Field of Classification Search ..... 52/506.07, 52/506.01, 506.06, 749.1; 29/432.2, 509, 29/521, 796, 243.529
See application file for complete search history.

(56) References Cited

U.S. PATENT DOCUMENTS 1,987,176 A 1/1935 Biggert
2,254,558 A 9/1941 Williams
2,671,361 A 3/1954 Sandberg
2,688,890 A 9/1954 Williams
2,924,312 A 2/1960 Williams
3,083,794 A 4/1963 Stovall, Jr.
3,198,155 A * 8/1965 Fraze ..... 413/8

(Continued)

FOREIGN PATENT DOCUMENTS

DE 44 32 639 A1 3/1996

(Continued)

*Primary Examiner*—Richard E Chilcot, Jr.
*Assistant Examiner*—Mark R Wendell
(74) *Attorney, Agent, or Firm*—Cook Alex Ltd.

(57) ABSTRACT

A method for securing two pieces of sheet material is provided using a stitch preferably made by sequentially passing the grid member through two die sets. The first die set lances a strap out of the two sheets of metal such that, at the approximate center or midsection of the strap, the first layer of material is displaced completely out of the plane defined by the web, while the second layer is only partially displaced out of the plane of the web so that a portion of the second layer remains in the space vacated by the first layer of the strap. The lanced strap is then passed through a second die set, in which the first and second layers of the strap are deformed or "swaged" such that the first layer is flattened and expanded in width beyond the edges of the hole in the web created when the strap was lanced. This provides interference such that the first layer of the strap cannot pass back through the hole. Additionally, the strap in the second web is deformed and displaced into the first web to bond the two together.

6 Claims, 2 Drawing Sheets

U.S. PATENT DOCUMENTS

| | | | | | |
|---|---|---|---|---|---|
| 3,579,809 | A | | 5/1971 | Wolf et al. | |
| 3,599,318 | A | | 8/1971 | Behlen | |
| 3,726,000 | A | | 4/1973 | Hafner | |
| 3,728,779 | A | | 4/1973 | Behlen et al. | |
| 3,786,979 | A | | 1/1974 | Muller | |
| 3,900,937 | A | * | 8/1975 | Schleicher | 29/566.1 |
| 3,919,955 | A | | 11/1975 | DuVernay | |
| 3,934,327 | A | | 1/1976 | Hafner | |
| 3,981,064 | A | | 9/1976 | Hafner | |
| 4,306,511 | A | | 12/1981 | Ashby et al. | |
| 4,394,794 | A | | 7/1983 | Shirey | |
| 4,459,735 | A | | 7/1984 | Sawdon | |
| 4,489,529 | A | | 12/1984 | Ollinger et al. | |
| 4,531,279 | A | * | 7/1985 | Gunter | 29/509 |
| 4,658,502 | A | | 4/1987 | Eckold et al. | |
| 4,660,403 | A | | 4/1987 | Slasinski | |
| 4,712,350 | A | | 12/1987 | Vukmanic | |
| 4,757,609 | A | | 7/1988 | Sawdon | |
| 4,760,632 | A | | 8/1988 | Rapp | |
| 4,760,634 | A | | 8/1988 | Rapp | |
| 4,831,704 | A | | 5/1989 | Rapp | |
| 4,831,711 | A | | 5/1989 | Rapp | |
| 4,835,850 | A | | 6/1989 | Eckhold et al. | |
| 4,896,414 | A | | 1/1990 | Hafner | |
| 4,897,912 | A | | 2/1990 | Slasinski | |
| 4,910,853 | A | | 3/1990 | Sawdon | |
| 5,051,020 | A | | 9/1991 | Schleicher | |
| 5,177,861 | A | | 1/1993 | Sawdon | |
| 5,208,973 | A | | 5/1993 | Sawdon | |
| 5,230,136 | A | | 7/1993 | Cronn et al. | |
| 5,305,517 | A | | 4/1994 | Schleicher | |
| 5,408,735 | A | | 4/1995 | Schleicher | |
| 5,432,989 | A | | 7/1995 | Turek | |
| 5,435,049 | A | | 7/1995 | Sawdon | |
| 5,517,743 | A | * | 5/1996 | Liebig et al. | 29/521 |
| 5,577,313 | A | | 11/1996 | Guido et al. | |
| 5,581,860 | A | | 12/1996 | Sawdon | |
| 5,621,961 | A | | 4/1997 | Schleicher | |
| 5,979,055 | A | | 11/1999 | Sauer et al. | |
| 5,984,563 | A | | 11/1999 | Wu | |
| 6,047,511 | A | | 4/2000 | Lehane et al. | |
| 6,446,407 | B1 | | 9/2002 | Lehane et al. | |
| 7,595,977 | B2 | * | 9/2009 | Kim | 361/679.01 |
| 2003/0037428 | A1 | | 2/2003 | Wang et al. | |
| 2006/0686792 | | | 8/2006 | Reatherford et al. | |
| 2007/0028554 | A1 | | 2/2007 | Ferrell et al. | |
| 2007/0113507 | A1 | | 5/2007 | Lehane et al. | |
| 2007/0125038 | A1 | | 6/2007 | Lehane, Jr. et al. | |
| 2007/0175152 | A1 | | 8/2007 | Kupec et al. | |
| 2008/0134611 | A1 | | 6/2008 | Lehane et al. | |
| 2008/0289169 | A1 | | 11/2008 | Rapp | |
| 2009/0068399 | A1 | | 3/2009 | Murakami et al. | |

FOREIGN PATENT DOCUMENTS

| | | | |
|---|---|---|---|
| GB | 2 142 356 | A | 6/1984 |
| GB | 2 087 284 | A | 2/1985 |
| GB | 2 274 080 | A | 12/1993 |
| WO | WO 89/10808 | | 11/1989 |
| WO | WO 94/22613 | | 10/1994 |

* cited by examiner

ROTARY STITCH FOR JOINING SHEET METAL STOCK

CROSS REFERENCE TO RELATED APPLICATION

This application claims the benefit of U.S. Provisional Application Ser. No. 61/100,443 filed Sep. 26, 2008, the entire contents of which is incorporated by reference herein.

BACKGROUND

Methods for joining together sheet metal stock are disclosed generally in U.S. Pat. Nos. 5,577,313 to Guido et al., 5,979,055 to Sauer et al., and 6,446,407 to Lehane et al., each of which is incorporated by reference herein. These patents generally disclose methods for joining two sheets of material together with a series of stitches formed in two passes through rotary dies in which a strap is lanced such that the two layers of the strap are displaced completely out of the two sheets in the first pass. In the second pass, the strap is "coined" to deform the two layers of the strap, making it larger, so as to prevent the strap from passing back through the hole. Alternatively, the hole created for forming the strap may be coined, making it narrower than the strap lanced therefrom, thus also preventing the strap from passing back through the hole.

SUMMARY

The present disclosure relates to a stitch for joining together two pieces of sheet metal. The stitch may be advantageously utilized in a grid member for a suspended ceiling system having an inverted T-shape, with an intermediate web having a strengthening bulb at its upper end and opposed flanges at its lower end. (As used herein, "flange" may also refer to a bolt slot.) The web comprises two layers of sheet material that are secured to each other by a series of stitches.

In accordance with the disclosure, each stitch is preferably made by sequentially passing the grid member through two die sets. The first die set lances a strap out of the two sheets of metal such that, at the approximate center or midsection of the strap, the first layer of material is displaced completely out of the plane defined by the web, while the second layer is only partially displaced out of the plane of the web so that a portion of the second layer remains in the space vacated by the first layer of the strap.

The lanced strap is then passed through a second die set, in which the first and second layers of the strap are deformed or "swaged" such that the first layer is flattened and expanded in width beyond the edges of the hole in the web created when the strap was lanced. This provides interference such that the first layer of the strap cannot pass back through the hole. Additionally, the strap in the second web is deformed and displaced into the first web. To this end, the second die set preferably comprises a first rotary element with a male portion that is received in the space vacated by the lanced strap. The male portion has a width narrower than the width of the hole created by the lancing of the strap. Preferably, the male portion has a tapered configuration. However, other configurations may also be used, such as straight-sided. A second rotary element in the second die set comprises a female portion that has an opening wider than the lanced straps. The male portion of the first rotary element thus permits the edges of the second layer of the strap to be deformed into the space between the edges of the male portion of the tool and the edges created by lancing of the strap, while the female portion facilitates the lateral expansion of the first layer of the strap.

DETAILED DESCRIPTION

Figure 1:
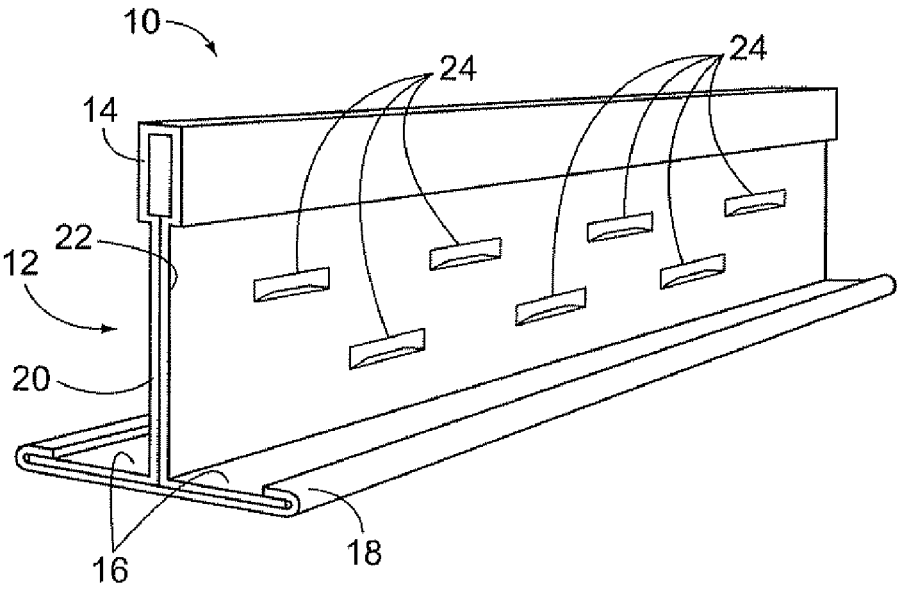
FIG. 1 is a perspective view of a tee for a suspended ceiling grid including a plurality of stitches according to the present disclosure for securing the layers of the vertical web to each other.

Turning to the drawings, there is seen in FIG. 1 a perspective view of a grid member 10 for use in a suspended ceiling grid system. The grid member 10 is typically made from sheet metal in a roll-forming operation, and it may advantageously formed with a plurality of stitches in accordance with the present disclosure. As is typical, the grid member 10 has an inverted T-shape, with a vertically extending intermediate web 12 having a strengthening bulb 14 at its upper end and opposed flanges 16 at its lower end. A cap member 18 spans the flanges 16, providing both enhanced strength and a more aesthetically pleasing appearance.

The web 12 is formed of a double layer of sheet metal. Preferably, the two layers 20, 22 are locked together in abutting contact by a series of stitches 24 running substantially the length of the grid member 10. As shown, the web 12 has two rows of stitches, with the stitches in each row being staggered relative to the stitches in the other row. Such stitches greatly enhance the torsional rigidity, and thus the load-bearing capacity, of the grid member.

In accordance with the present disclosure, a stitch configuration is provided which can be made in a roll-forming operation involving two pairs of rotary dies. A first pair of rotary die members lances a strap or slug from the two layers of sheet material. A second pair of rotary die members deforms the lanced strap such that the first layer of the strap is expanded to a size larger than the hole created by the lancing of the strap, thus preventing the expanded strap from passing back through the hole. The second layer of the strap is swaged or deformed into the first strap to essentially lock or bond it to the first strap.

Figure 2:
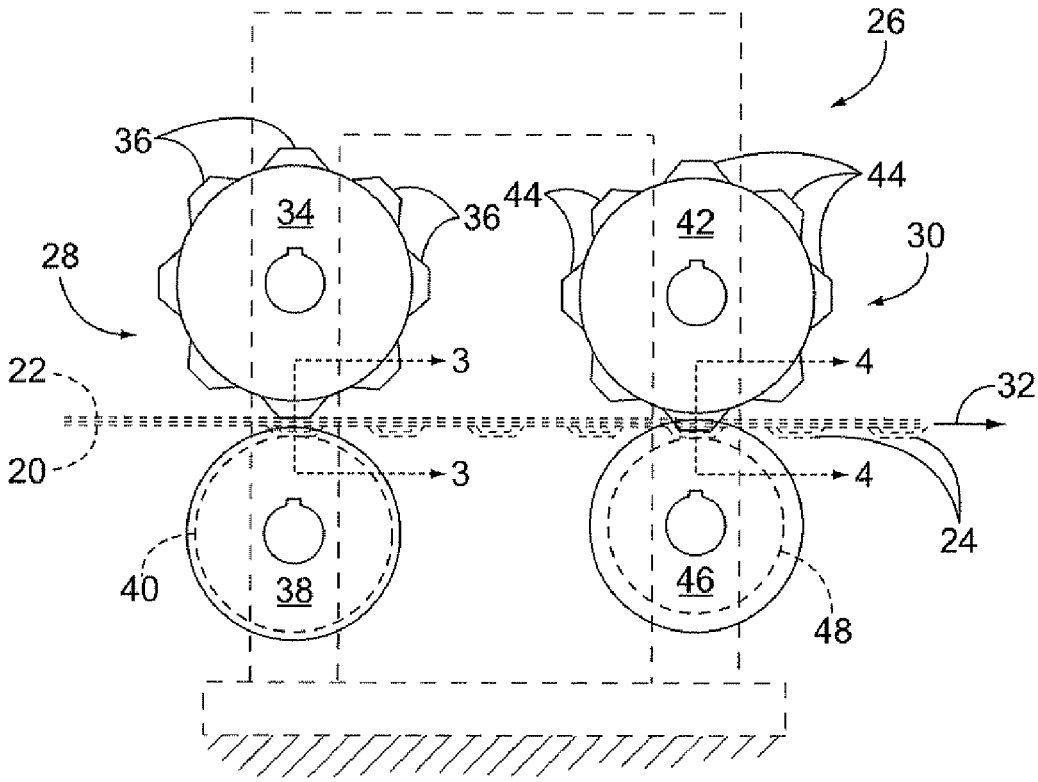
FIG. 2 is a schematic view of a two-stage roll forming apparatus for making a stitch in accordance with the present disclosure.
Figure 3:
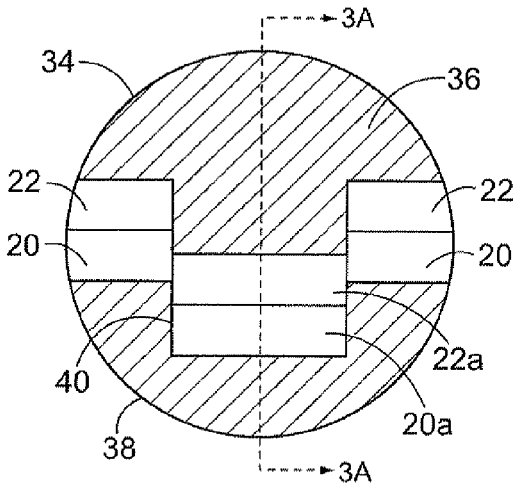
FIG. 3 is a fragmentary cross-sectional view taken along line 3-3 of FIG. 2.
Figure 3A:
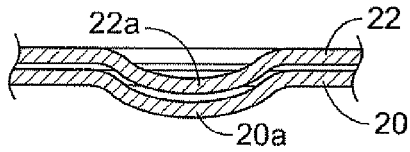
FIG. 3*a* is a cross-sectional view of the lanced strap taken along line 3*a*-3*a* of FIG. 3.

Turning to FIG. 2, there is seen a schematic representation of a roll-forming apparatus 26 for making the stitches of the present disclosure. The apparatus comprises a first rotary die set 28 and a second rotary die set 30 for sequentially forming a stitch by advancing two layers of sheet material 20, 22 through the apparatus in the direction of the arrow 32. The first die set 28 includes a first rotary element 34 that has a plurality of discrete forming elements or teeth 36, best seen in FIG. 3, spaced equidistantly around the periphery of the rotary element 34. A second rotary element 38 comprises a rotary backing element that has a peripheral groove or undercut 40, also best seen in FIG. 3. As illustrated, the teeth 36 and the groove 40 are complimentarily shaped, with both having a generally rectangular cross-sectional shape. As the two layers 20, 22 of sheet material pass through the first die set 28, a strap 20*a*, 22*a* is lanced out of each layer such that the ends of the straps 20*a*, 22*a* remain connected to their respective 20, 22 layers and the sides of the straps 20*a*, 22*a* are cut free. See FIG. 3*a*. Also, the straps 20*a*, 22*a* are displaced from their respective layers such that the mid-portion of the strap 20*a* in the first layer 20 is displaced completely out of the plane of its layer, and the strap 22*a* in the second layer 22 is displaced such that its mid-section is displaced completely out of the plane of its layer, but only partly past the outer, exposed surface of the first layer 20.

Figure 4:
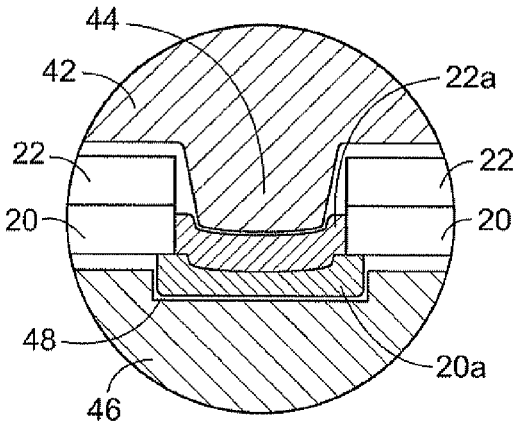
FIG. 4 is a fragmentary cross-sectional view taken along line 4-4 of FIG. 2.

The second die set 30 also includes a first rotary element 42 with a plurality of teeth 44 and a second rotary element 46 comprising a backing element. The backing element 46 has a generally rectangular groove 48 that is both shallower than the thickness of one layer of the sheet material and wider than the width of the strap lanced from the sheet. With reference to FIG. 4, the teeth 44 in the rotary element 43 are narrower than the strap lanced from the sheet material and have a height greater than that of the teeth 36 in the rotary element 34 of the first die set 28. Thus, as the lanced straps 20*a*, 22*a* pass through the second rotary die set 30, the strap 20*a* in the first layer 20 is expanded in width such that it is too wide to pass back through the hole formed when it was lanced from the first layer. Simultaneously, the strap 22*a* in the second layer 22 is deformed into the first strap 20*a*. During such deformation, lateral expansion of the second strap 22*a* is substantially constrained by the side walls of the hole in the first layer 20, the strap 22*a* instead deforming, at least partially, into the space between the side walls of the hole and the side walls of the teeth 44. By such operation, the second strap is essentially locked or bonded to the first strap 20*a*.

Figure 5:
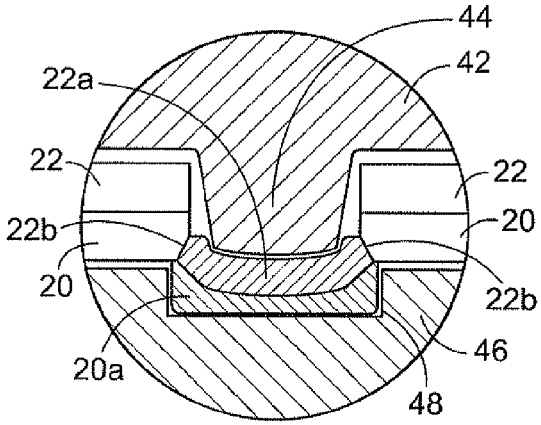
FIG. 5 is a fragmentary cross-sectional view similar to that of FIG. 4 showing an alternate configuration for the second rotary die set.

The height of the teeth 44 in the first rotary element 42 of the second die set 30 may be varied to result in a different interface between the first strap 20*a* and second strap 22*a*. For example, if the tooth height is increased, as shown in FIG. 5, the second strap 22*a* may be deformed such that at least a portion is enlarged in width and it forms a generally beveled surface 22*b* with the edges of the hole in the first sheet 20, thus providing greater resistance to movement of the second strap 22*a* back through the hole.

Consequently, a method for securing two adjacent layers of the sheet material to each other according to the present disclosure entails providing a first layer 20 of sheet material having first and second faces and a second layer 22 of sheet material having third and fourth faces. The second face of the first layer is brought into face-to-face relationship with the third face of the second layer and generally elongated straps 20*a*, 22*a* are lanced out of the first and second layers 20, 22 such that the straps have ends that remain attached to their respective layers and the sides are separated from their respective layers. Further, the straps 20*a*, 22*a* have mid-sections that are displaced such that both the first and second faces of the mid-section of the strap 20*a* in the first layer 20 are displaced past the first face of the first layer 20. The third face of the of the mid-section of the strap 22*a* in the second layer 22 is displaced past the first face of the first layer 20. While the fourth face of the mid-section of the strap 22*a* in the second layer 22 is displaced so that it resides between the first and second faces of the first layer 20. The lanced straps 20*a*, 22*a* are then swaged such that the mid-section of the strap 20*a* in the first layer 20 is enlarged in width, and the mid-section of the strap 22*a* in the second layer 22 is deformed into the first layer 20*a* so as to bond or secure it thereto.

Thus, a stitch configuration has been disclosed that may be made with rotary forming apparatus. While the stitch and the method of making the stitch have been described in terms of certain preferred embodiments, these are, by way of example, and not limitation.

The invention claimed is:

1. A method for securing two adjacent layers of a sheet material to each other comprising:

providing a first layer of metal having first and second faces;

providing a second layer of metal having third and fourth faces;

bringing the second face of the first layer into face-to-face relationship with the third face of the second layer;

lancing a generally elongated strap out of both the first and second layers such that the straps have ends that remain attached to their respective layers and sides that are separated from their respective layers, the straps having midsections that are displaced such that both the first and second faces of the midsection of the strap in the first layer are displaced past the first face of the first layer, while the third face of the midsection of the strap in the second layer is displaced past the first face of the first layer and the fourth face of the midsection of the strap in the second layer is displaced between the first and second faces of the first layer;

swaging the lanced strap such that the midsection of the strap in the first layer is enlarged in width and the midsection of the strap in the second layer is deformed into the first layer.

2. The method of claim 1 wherein swaging the lanced strap enlarges in width a portion of the strap in the second layer.

3. The method of claim 1 wherein the lancing and swaging steps are performed in a continuous operation by a series of rotary die pairs.

4. The method claim 3 wherein one die in each pair of rotary dies comprises a plurality of male elements having side faces, the side faces in the die for performing the lancing step being generally parallel and the side faces in the die for performing the swaging step forming an acute angle.

5. A grid tee for a suspended ceiling comprising sheet metal folded to form a longitudinally extending body with a cross-section having a vertically extending double web and a pair of opposed flanges integral with the web, the web having first and second elements each formed by a layer of sheet metal, the layers being side by side and together forming the plane of the web, the web elements being locked together in abutting contact by stitches integrally formed therein and spaced from one another along substantially the length of the tee, the stitches being formed by first and second straps lanced out of each of the first and second web elements, respectively, the first strap being displaced out of the plane to one side of the web and the second strap being displaced partially out of the plane of the web to the one side of the web, the material of the first strap being deformed so that the first strap is larger than a hole left in the web upon lancing the straps and the second strap is deformed into the first strap.

6. The grid tee of claim 5 wherein the second strap has a portion enlarged in width.

* * * * *